US010889981B2

(12) United States Patent
Fisler et al.

(10) Patent No.: US 10,889,981 B2
(45) Date of Patent: Jan. 12, 2021

(54) FOUNDATION WATERPROOFING AND INSULATION FORM SYSTEM AND METHOD

(71) Applicant: JOHNS MANVILLE, Denver, CO (US)

(72) Inventors: Diana Fisler, Centennial, CO (US); Zebonie Sukle, Denver, CO (US); ChangQing Shen, Centennial, CO (US); Guodong Zheng, Highlands Ranch, CO (US); Duane Paradis, Highlands Ranch, CO (US); Ralph Michael Fay, Lakewood, CO (US)

(73) Assignee: Johns Manville, Denver, CO (US)

( * ) Notice: Subject to any disclaimer, the term of this patent is extended or adjusted under 35 U.S.C. 154(b) by 0 days.

(21) Appl. No.: 15/806,084

(22) Filed: Nov. 7, 2017

(65) Prior Publication Data

US 2019/0136514 A1 May 9, 2019

(51) Int. Cl.
*E04B 1/80* (2006.01)
*E04G 9/10* (2006.01)
(Continued)

(52) U.S. Cl.
CPC ..... *E04B 1/762* (2013.01); *E04B 1/0007* (2013.01); *E04B 1/16* (2013.01); *E04B 1/665* (2013.01); *E04B 1/80* (2013.01); *E04B 2/8647* (2013.01); *E04G 9/10* (2013.01); *E04G 17/0654* (2013.01); *E04G 17/14* (2013.01); *E04B 2103/04* (2013.01); *E04G 11/08* (2013.01)

(58) Field of Classification Search
CPC ..... E04B 1/762; E04B 1/0007; E04B 1/665; E04B 1/80; E04B 1/16; E04B 2/8647; E04B 2103/04; E04B 2/84; E04B 5/32; E04G 9/10; E04G 17/0654; E04G 17/14; E04G 9/06; E04G 11/06; E04G 11/08; E04G 11/38
See application file for complete search history.

(56) References Cited

U.S. PATENT DOCUMENTS 3,381,929 A * 5/1968 Bancker ..... E04G 9/02 249/5
3,788,020 A * 1/1974 Gregori ..... E04B 2/54 52/309.12

(Continued)

OTHER PUBLICATIONS

Sika Corporation, SikaProof® Fully Bonded Membrane Systems for Watertight Basements, Jun. 2017, Sika Corporation, Louis, MO.

(Continued)

*Primary Examiner* — Phi D A
(74) *Attorney, Agent, or Firm* — Robert D. Touslee

(57) ABSTRACT

Systems and methods for making a waterproofed concrete wall assembly, such as for a basement wall. A form is constructed. At least a first side of the form is made of one or more boards having a polymer foam and a fibrous facer. At least some of the boards have perimeter edges shaped such that some adjacent boards overlap at the shaped perimeter edges. Concrete is poured into the gap between the sides of the form, and is allowed to harden. The other side of the form may be removed, while leaving the boards of the first side of the form in place adjacent the hardened concrete. Some of the concrete is infused into the fibrous facers of at least some of the boards.

16 Claims, 10 Drawing Sheets

(51) Int. Cl.

| | |
|---|---|
| ***E04B 1/76*** | (2006.01) |
| ***E04B 1/00*** | (2006.01) |
| ***E04B 1/66*** | (2006.01) |
| ***E04B 1/16*** | (2006.01) |
| ***E04B 2/86*** | (2006.01) |
| ***E04G 17/14*** | (2006.01) |
| ***E04G 17/065*** | (2006.01) |
| *E04G 11/08* | (2006.01) |

(56) References Cited

U.S. PATENT DOCUMENTS

| | | | | |
|---|---|---|---|---|
| 4,730,953 | A | 3/1988 | Tarko | |
| 4,885,888 | A | 12/1989 | Young | |
| 5,038,541 | A | 8/1991 | Gibbar | |
| 5,098,059 | A * | 3/1992 | Sawyer | E04G 9/05 249/112 |
| 5,375,809 | A | 12/1994 | Goto | |
| 5,992,114 | A | 11/1999 | Zelinsky et al. | |
| 6,279,275 | B1 | 8/2001 | Sawyer | |
| 6,526,713 | B2 | 3/2003 | Moore, Jr. | |
| 6,698,710 | B1 | 3/2004 | VanderWerf | |
| 7,871,055 | B1 * | 1/2011 | Dagher | E04G 9/02 249/195 |
| 8,752,349 | B2 * | 6/2014 | Westaby | E04B 2/8658 52/426 |
| 8,966,845 | B1 * | 3/2015 | Ciuperca | E04B 1/80 52/309.12 |
| 9,115,503 | B2 | 8/2015 | Ciuperca | |
| 2007/0107341 | A1 * | 5/2007 | Zhu | E04B 1/161 52/309.12 |
| 2011/0239566 | A1 * | 10/2011 | Ciuperca | B23P 11/00 52/259 |
| 2012/0058299 | A1 * | 3/2012 | Serwin | E04C 2/288 428/131 |
| 2017/0009469 | A1 | 1/2017 | Ciuperca | |
| 2017/0101775 | A1 | 4/2017 | White | |
| 2017/0121988 | A1 | 5/2017 | McDonagh | |
| 2017/0129211 | A1 * | 5/2017 | Bradenburg | C04B 16/0633 |
| 2017/0175407 | A1 | 6/2017 | Richardson et al. | |
| 2017/0198475 | A1 | 7/2017 | Montoya | |
| 2017/0218614 | A1 | 8/2017 | Ciuperca | |
| 2017/0218644 | A1 | 8/2017 | Ciuperca | |
| 2019/0136515 | A1 * | 5/2019 | Fredericks, II | E04B 1/0007 |

OTHER PUBLICATIONS

Sika Corporation, SikaProof® A Fully Bonded FPO Sheet Membrane Waterproofing System for Basement and other Below Grade Structures, Sep. 29, 2016, Sika Corporation, Lyndhurst, NJ.

* cited by examiner

FOUNDATION WATERPROOFING AND INSULATION FORM SYSTEM AND METHOD

BACKGROUND OF THE INVENTION

Poured concrete walls are widely used for foundations, basements, tunnels, and other underground structures. Concrete walls have many advantages, including high strength and durability. Concrete walls can be made to suit nearly any floor plan.

However, concrete is not inherently waterproof, and is not a good thermal insulator. Because backfilled earth may be in direct contact with a basement wall for decades or more, measures are typically taken to prevent seepage of water from the surrounding soil through the concrete wall and into the interior of the structure. Additional thermal insulation may also be provided below ground level, either outside the concrete wall or inside.

BRIEF SUMMARY OF THE INVENTION

According to one aspect, a waterproofed concrete wall assembly comprises a vertical wall of hardened concrete and a plurality of boards. The wall has a first side and a second side. Each of the plurality of boards comprises opposite first and second major surfaces and also comprises perimeter edges between the major surfaces. Each of the plurality of boards comprises a polymer foam layer and a fibrous facer joined to the polymer foam layer. The first major surface of each of the plurality of boards is disposed in contact the first side of the vertical wall of hardened concrete. At least some of the perimeter edges of the boards are shaped to overlap with shaped perimeter edges of one or more adjacent boards. Some of the concrete is infused into the fibrous layer, the fibrous layer having been present during pouring of the concrete. In some embodiments, at least some of the perimeter edges of the boards comprise caps shaped to provide the overlapping shapes. The caps may be made of metal, plastic, or polymer foam. In some embodiments, the polymer foam of the polymer foam layer is a polyisocyanurate foam. In some embodiments, the polyisocyanurate foam has a density between 2.5 $lb/ft^3$ and 25 $lb/ft^3$. In some embodiments, wherein the polyisocyanurate foam has a density between 4 $lb/ft^3$ and 15 $lb/ft^3$. In some embodiments, the fibrous facer is a nonwoven facer comprising fiberglass. In some embodiments, the fibrous facer is a nonwoven spunbond facer comprising polyester or polypropylene. In some embodiments, the waterproofed concrete wall of assembly further comprises a sealant placed at the shaped perimeter edges of at least some adjacent boards. The sealant may be a compressible polymeric foam. The sealant may be a pre-applied adhesive. In some embodiments, the waterproofed concrete wall of assembly comprises tape positioned to seal joints between adjacent boards on the second major surfaces of the adjacent boards. In some embodiments, the waterproofed concrete wall of assembly further comprises a waterproof layer in contact with the second major surfaces of the boards. In some embodiments, the waterproof layer is a membrane comprising one or more substances selected from the group of substances consisting of styrene butadiene styrene (SBS), thermoplastic polyolefin (TPO), ethylene propylene diene monomer (EPDM), and polyamide film (nylon). In some embodiments, the waterproof layer is a second facer joined to the polymer foam. In some embodiments, at least some of the boards comprise multiple layers of polymer foam of different densities.

According to another aspect, a method of making a waterproofed concrete wall assembly comprises constructing a form. The form has a first side and a second side, and the first and second sides define a gap between the first and second sides for receiving poured concrete. The first side is made of one or more boards each comprising a polymer foam and a fibrous facer. At least some of the boards have perimeter edges shaped such that some adjacent boards overlap at the shaped perimeter edges. The method further comprises pouring concrete in the gap between the first and second sides of the form, and allowing the concrete to harden, some of the concrete having infused into the fibrous facers of at least some of the boards. In some embodiments, the method further comprises removing the second side of the form, while leaving the boards of the first side of the form in place adjacent the hardened concrete. In some embodiments, the boards comprise polyisocyanurate foam. In some embodiments, the method further comprises sealing joints between the boards using a tape, a sealant, or a combination of tape and sealant. In some embodiments, the method further comprises installing form ties between the first and second form sides before pouring the concrete, to prevent expansion of the gap due to hydrostatic pressure of the poured concrete, wherein the form ties protrude from both sides of the form; removing the protruding portions of the form ties once the concrete is hardened; and sealing the points at which the form ties formerly protruded through the boards using a tape, a sealant, or a combination of tape and sealant. In some embodiments, the boards form an outside surface of the wall. In some embodiments, the second side of the form is made of one or more boards comprising a polymer foam.

DETAILED DESCRIPTION OF THE INVENTION

Figure 1:
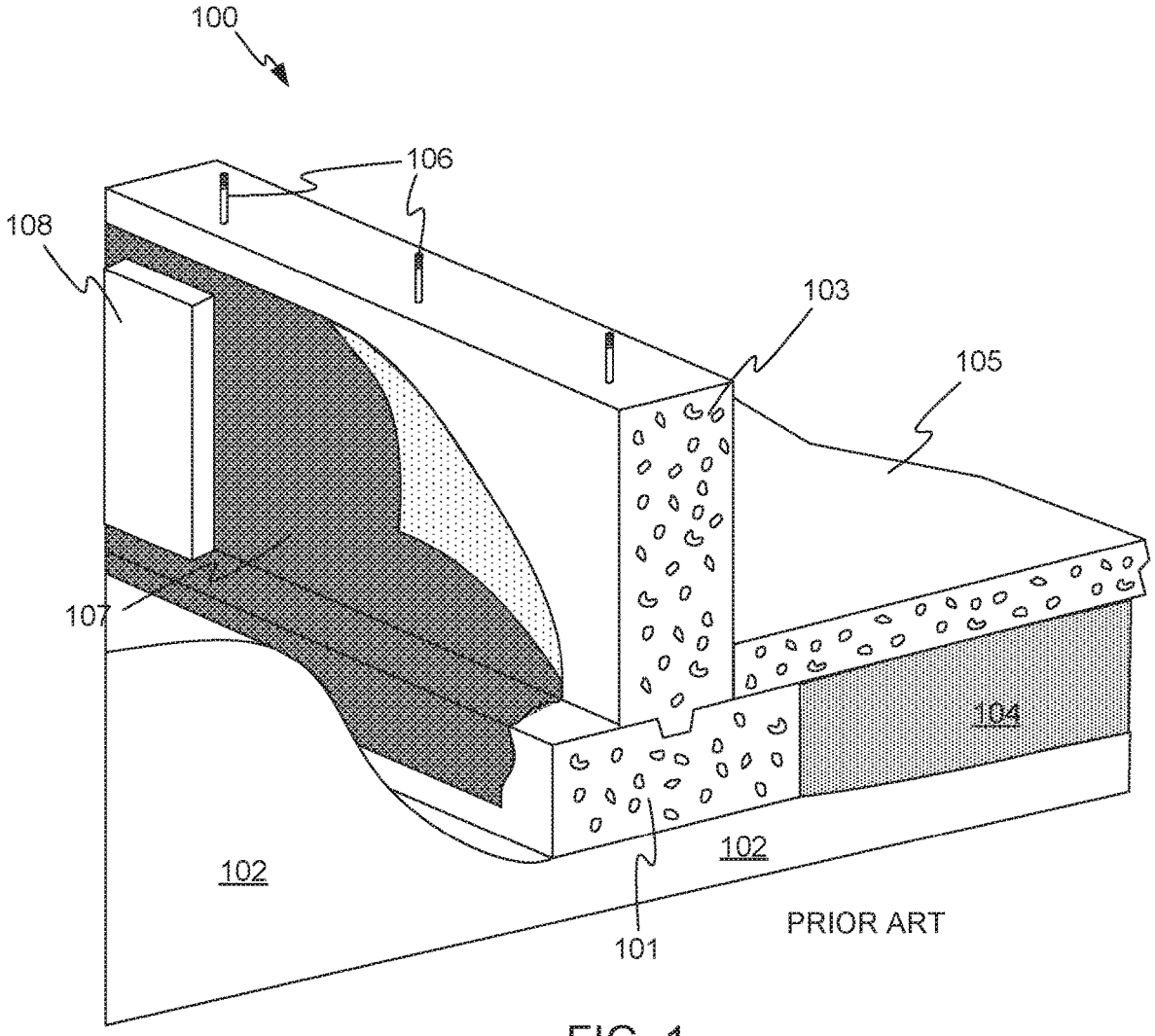
FIG. 1 illustrates a typical prior art poured concrete foundation wall installation.

FIG. 1 illustrates a typical prior art poured concrete foundation wall installation 100. A footer 101 preferably rests on undisturbed soil 102. Foundation wall 103 is poured on top of footer 101. Fill 104, for example gravel, is placed on the interior side of footer 101, and a slab floor 105 may be poured on top of fill 104. Anchor bolts 106 may be set in wall 103 at the time of pouring, for attachment of framed walls.

Waterproofing 107 may be applied to the exterior surface of wall 103. Waterproofing may be, for example, a liquid coating applied to foundation wall 103, or may be in the form of a membrane as shown. Additional insulation 108, such as polystyrene foam, may be applied outside of waterproofing 107, for providing thermal insulation and protecting waterproofing layer 107 during backfilling of wall 103.

Various reinforcing bars and meshes may be placed in footer 101, wall 103, and floor 105.

Figure 2:
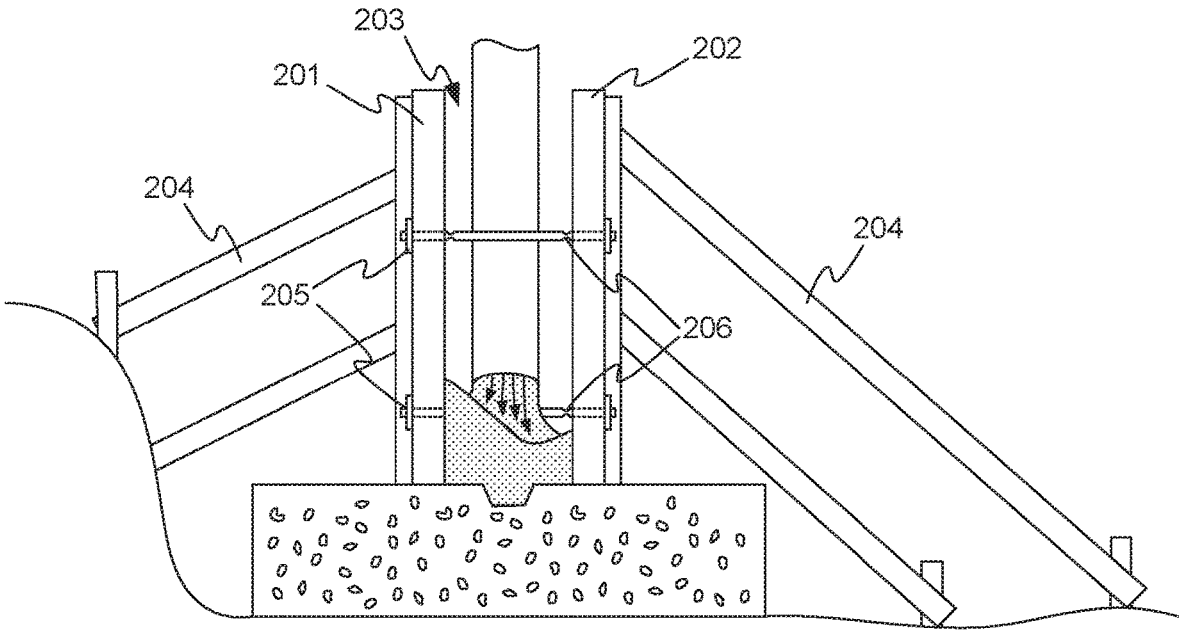
PRIOR ART FIG. 2
FIG. 2 shows typical forms having two parallel vertical sides separated by a space for receiving poured concrete.
Figure 3:
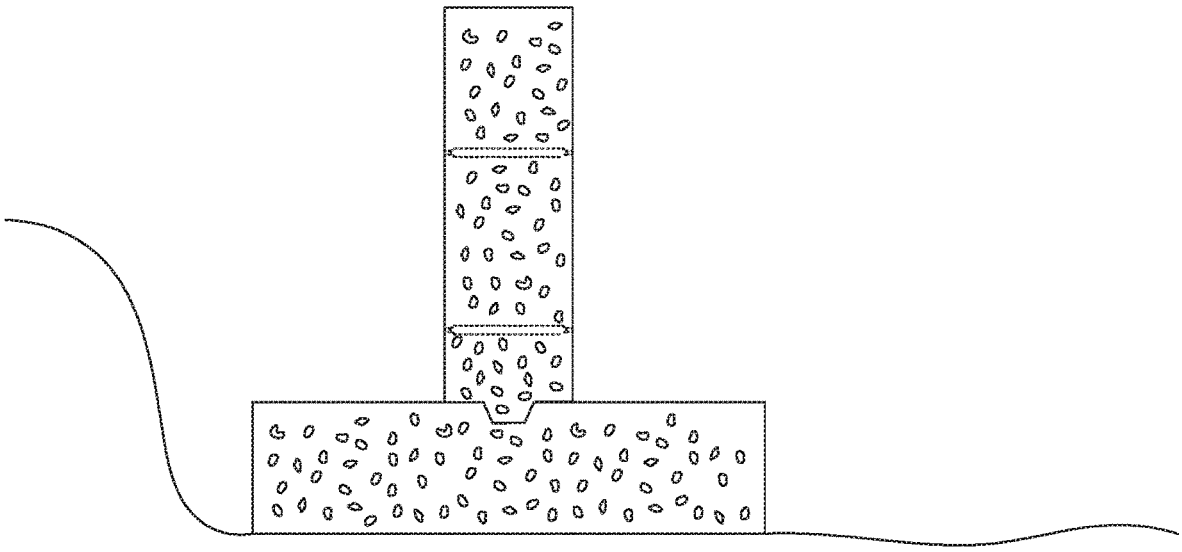
PRIOR ART FIG. 3
FIG. 3 shows a hardened wall with the forms removed.

For pouring of foundation wall 103, forms are typically assembled. FIG. 2 shows typical forms having two parallel vertical sides 201 and 202 separated by a space 203 for receiving the poured concrete. Vertical sides 201 and 202 are often made of plywood, but can also be made of more durable and rigid materials such as aluminum, steel, or other metals. Bracing 204 may be provided for holding sides 201 and 202 against the hydrostatic pressure of the poured concrete. In addition, form ties 205 may be provided. Form ties 205 hold sides 201 and 202 together against the pressure of the concrete, and the concrete is poured around them. Form ties 205 may include weakened points 206. After the wall is poured and hardened, the forms are removed, leaving a bare concrete wall. The protruding ends of form ties 205 are preferably broken off, with the ties snapping apart at weakened points 206, to leave an unobstructed face. The resulting hardened wall is shown in FIG. 3. Waterproofing 107 may typically not be applied for up to 30 days after pouring of wall 103, to allow wall 103 to cure before waterproofing 107 is applied.

According to embodiments of the invention, waterproofing is provided for a concrete wall as part of the process of fabrication of the wall.

Figure 4:
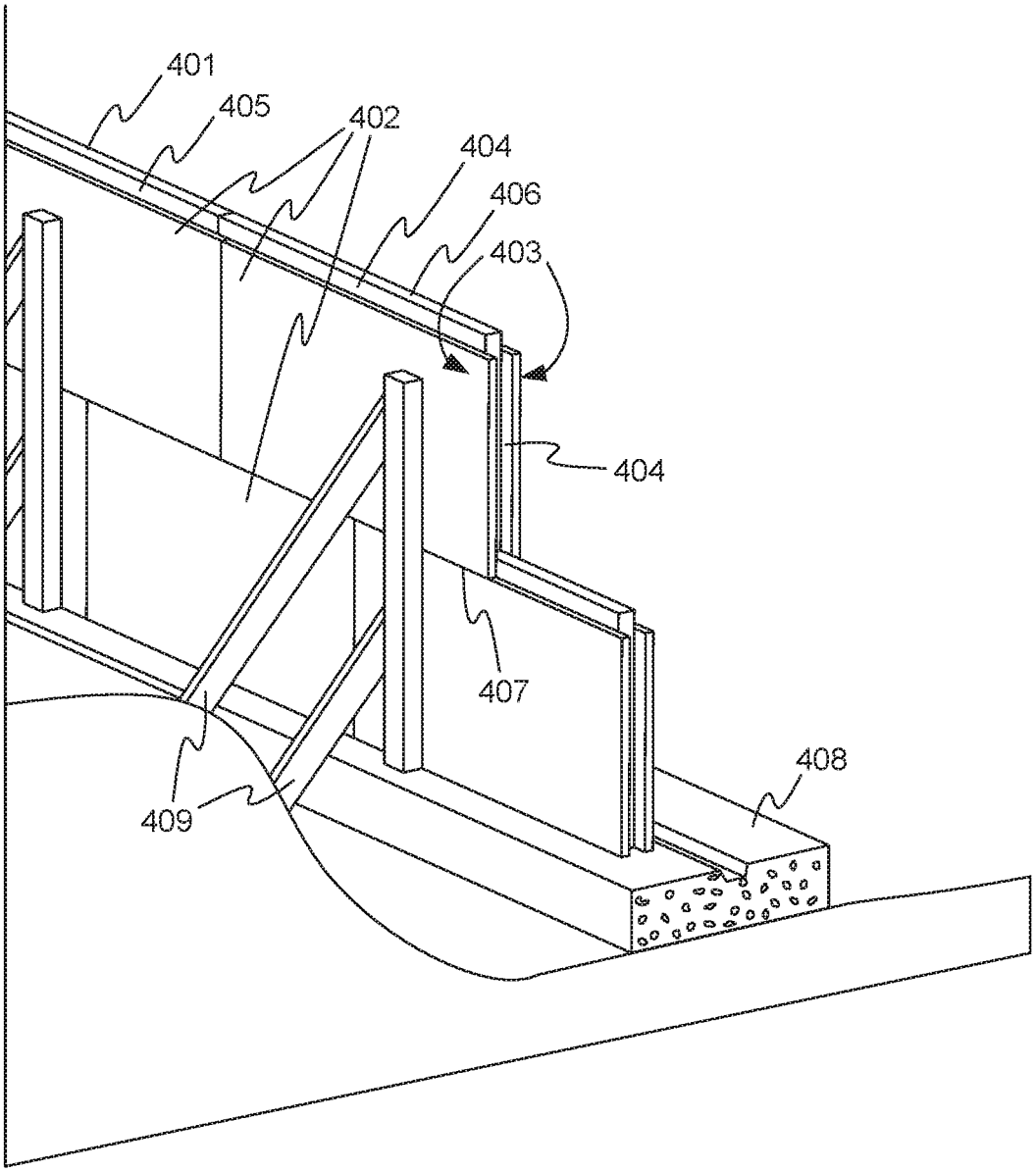
FIG. 4 illustrates a step in making a waterproofed concrete wall assembly, in accordance with embodiments of the invention.

FIG. 4 illustrates a step in making a waterproofed concrete wall assembly, in accordance with embodiments of the invention. FIG. 4 shows the construction of a first side 401 of a form. First side 401 is made of a number of boards 402. Each board 402 has opposite major surfaces 403 and perimeter edges 404 between the major surfaces. As is explained in more detail below, each of boards 402 comprises polymer foam layer and a fibrous facer joined to the polymer foam layer at one of the major surfaces (not visible in FIG. 4).

At least some of perimeter edges 404 of boards 402 are shaped to overlap with shaped perimeter edges 404 of one or more adjacent boards. In the example of FIG. 4, top perimeter edges 405 of at least some of boards 402 are formed with upstanding tongues 406, and bottom perimeter edges 407 of at least some of boards 402 are formed with grooves (not readily visible in FIG. 4). When boards 402 are stacked as shown, tongues 406 of the bottom course of boards 402 fits into the grooves on the top course of boards 402, creating an overlap. The ends of the boards are similarly formed with tongues on one end and grooves on the other, so that a similar overlap is formed in the horizontal direction.

Boards 402 may be trimmed, for example to remove the groove on the bottom edge that fits against previously-poured footer 408. Bracing 409 is preferably placed to hold form side 401 vertical. Bracing 409 will also serve to hold form side 401 in place against the hydrostatic pressure of the concrete that will eventually be poured.

Figure 5:
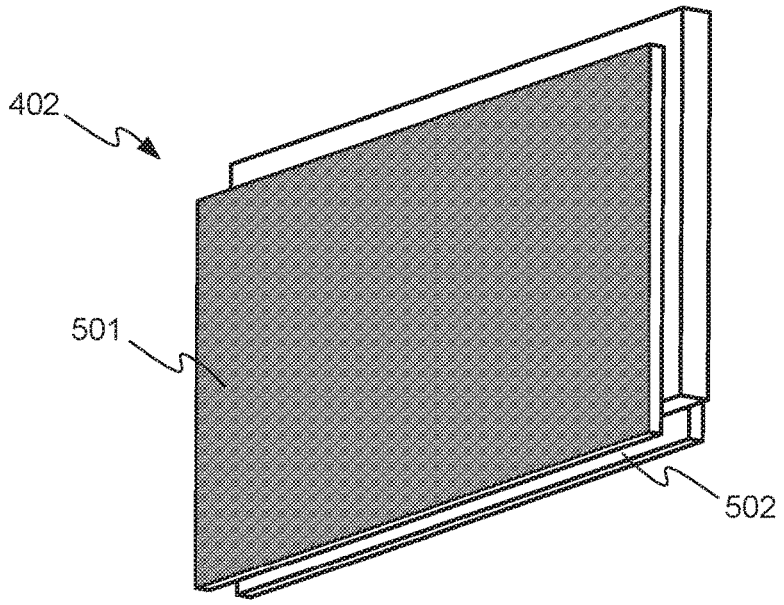
FIG. 5 is a reverse lower oblique view of a board in accordance with embodiments of the invention.
Figure 6:
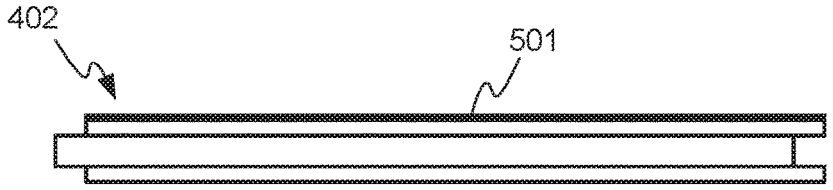
FIG. 6 shows a top orthogonal view of the board of FIG. 5.
Figure 7:
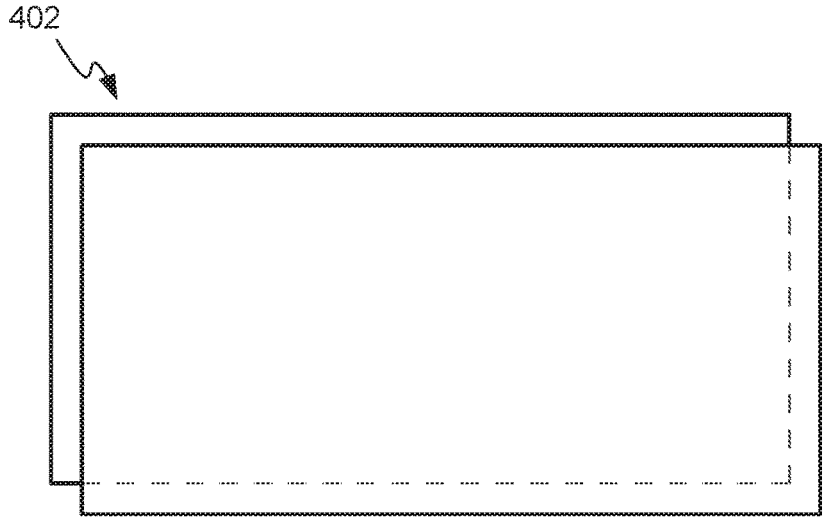
FIG. 7 shows an orthogonal face view of the board of FIG. 5.
Figure 8:
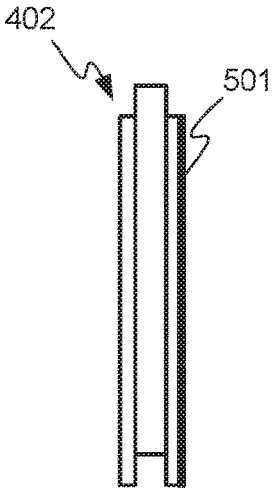
FIG. 8 shows in orthogonal end view of the board of FIG. 5.

FIGS. 5-8 illustrate one of boards 402 in more detail, in accordance with an example embodiment. FIG. 5 is a reverse lower oblique view, showing fibrous facer 501 in place on one major surface of board 402. Groove 502 is also visible along the bottom edge of board 402. (While the edges are referred to as "top" and "bottom", these designations refer only to the orientation of boards 402 in the figures. The boards may be installed in any orientation if desired.) FIG. 6 shows a top orthogonal view, FIG. 7 shows an orthogonal face view, and FIG. 8 shows in orthogonal end view. Facer 501 is visible edge-on in FIGS. 6 and 8. Facer 501 may be, for example, a nonwoven spunbond facer, and may comprise polyester, polypropylene, or other materials or combinations of materials.

Figure 9:
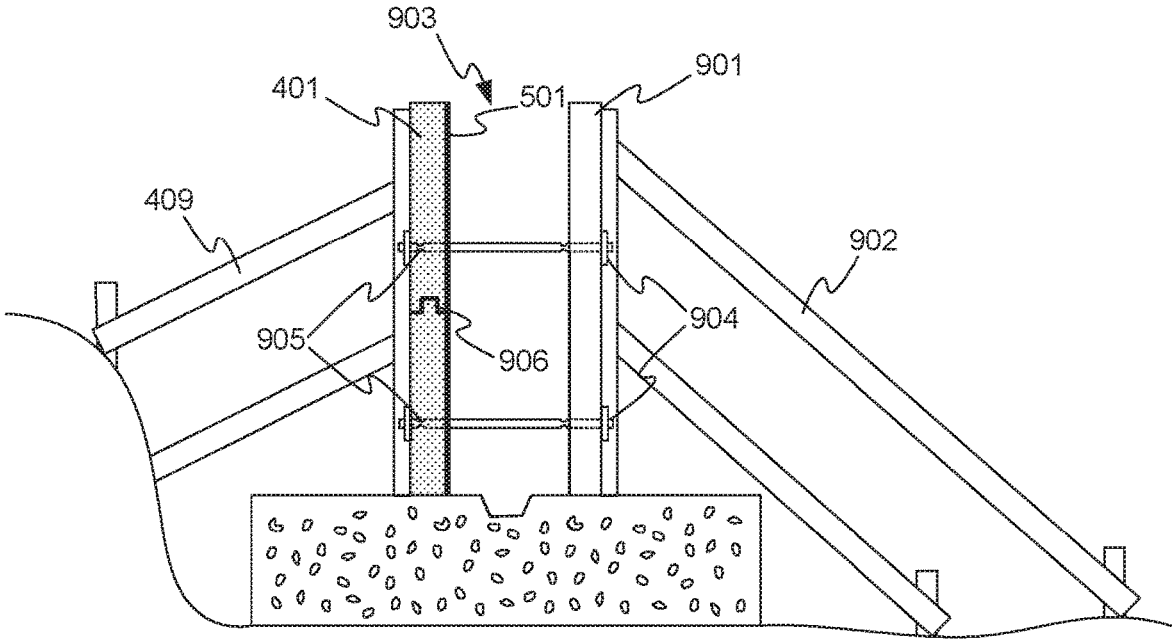
FIG. 9 shows a further stage in making a waterproofed concrete wall assembly, in accordance with embodiments of the invention.

FIG. 9 shows a further stage in making a waterproofed concrete wall assembly, in accordance with embodiments of the invention. A second side 901 of the form is erected, and preferably held in place by bracing 902. The two sides 401 and 901 of the form define a space 903 between them for receiving poured concrete. Second side 901 of the form may be conventional, or may also be made of boards such as boards 402. Preferably, at least the outer side (the side of the form defining the outdoor face of the wall) of the form is made of one or more boards comprising polymer form.

A joint 906 is visible between the upper and lower courses of boards 402, showing the overlapping of the material of the upper and lower boards 402. For the purposes of this disclosure, "overlap" between adjacent boards means that the perimeter edges of the boards are shaped such that there is at least one straight-line path, perpendicular to the eventual wall, that encounters material of both of the adjacent boards.

Form ties 904 having weakened points 905 may be placed for further resistance to the hydrostatic pressure of the poured concrete. However, it is preferable that bracing 409 and 902 be sufficient to hold form sides 401 and 901 in place, so that no form ties are needed.

Figure 10:
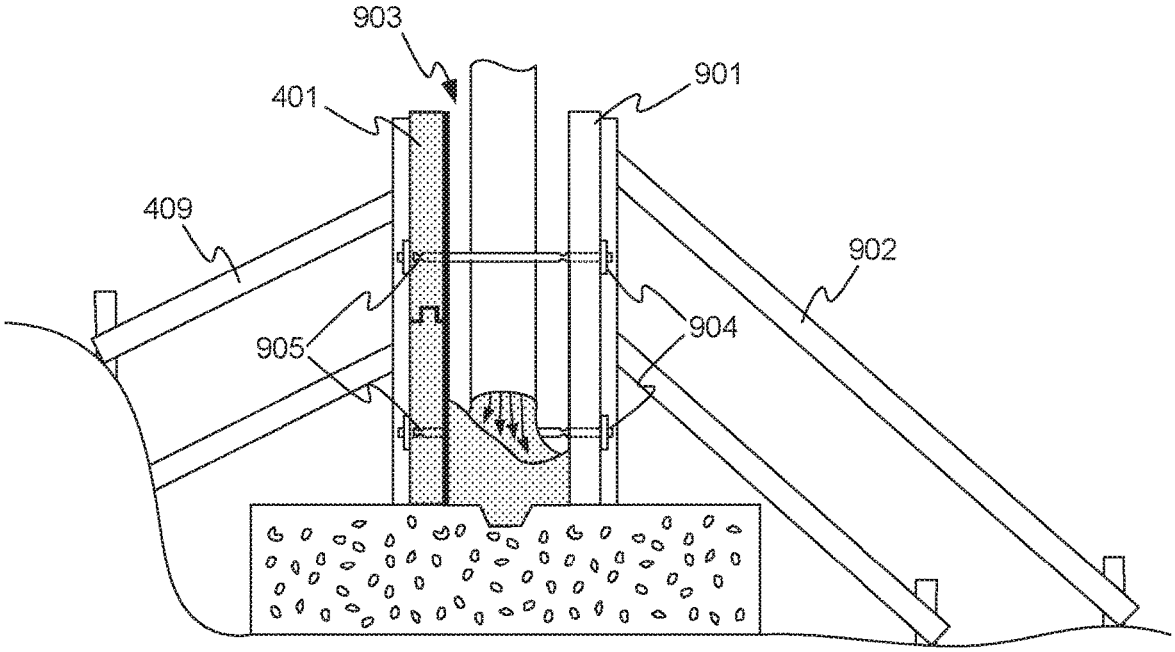
FIG. 10 illustrates the process of pouring concrete into the form shown in FIG. 9, in accordance with embodiments of the invention.
Figure 11:
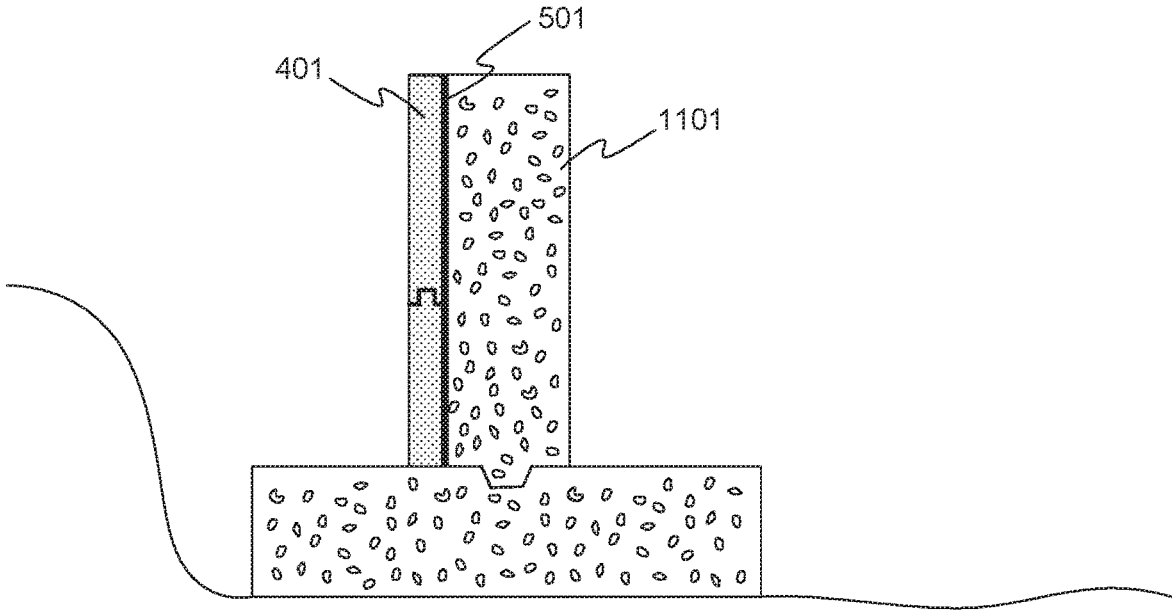
FIG. 11 shows the wall assembly as poured in FIG. 10, in accordance with embodiments of the invention.

With form sides 401 and 901, bracing 409 and 902, any optional form ties 904, and any reinforcing bars or mesh (not shown) in place, concrete is poured in space 903 as shown in FIG. 10. Once the concrete has hardened, form side 901 and bracing 409 and 902 are removed. The breakaway ends of any form ties 904 are broken off, leaving the wall assembly 1101 as shown in FIG. 11. Form side 401 is left in place. Inner facer 501 naturally adheres to the concrete of wall assembly 1101, so that side 401 is securely joined to the concrete.

Any suitable foam-containing boards may be used for boards 402, but boards that may be particularly suitable include Invinsa® and GoBoard® boards available from Johns Manville of Denver, Colo., USA.

Invinsa® boards include a polyisocyanurate core and mineral-coated fiberglass-reinforced facers 501 on both sides. These boards are readily available in 4 ft.×4 ft. and 4 ft. by 8 ft. sizes, and are typically ¼ in. thick, although other board sizes and thicknesses may be used if desired. The density of the polyisocyanurate core may be about 2.5 to 8 lb/ft$^3$, and typically about 3.5 to 4.5 lb/ft$^3$, although other densities may be used. In other embodiments, boards having facers on only one side may be used. In that case, the facer is preferably placed adjacent space 903, so that the poured concreted will directly contact the facer.

GoBoard® boards also include a polyisocyanurate core and a fiberglass facer. GoBoard® boards are readily available in 3 ft. by 5 ft. and 4 ft. by 8 ft. sizes, in thicknesses ranging from ¼ in. to 2 in., although other sizes and thicknesses may be used if desired. The density of the polyisocyanurate core is typically about 10 lb/ft$^3$, although other densities may be used.

In some embodiments, the thickness or density (or both) of the boards may be selected to meet the flexural and other requirements of the concrete forms. For example, densities of between 2.5 lb/ft$^3$ and 25 lb/ft$^3$ may be used, and thicknesses between 1 and 6 inches. In other embodiments, densities and thicknesses outside these ranges may be used. In addition, longer boards may be used, for example 4 ft. by 12 ft. or 4 ft. by 16 ft., to reduce the number of seams in an installation.

The polyisocyanurate core of these boards makes the boards waterproof, and the fibrous facer bonds well to concrete, because the uncured concrete can infuse into the fibrous facer to some degree. In other embodiments, different kinds of foam may be used, for example polyurethane foam.

Figure 12:
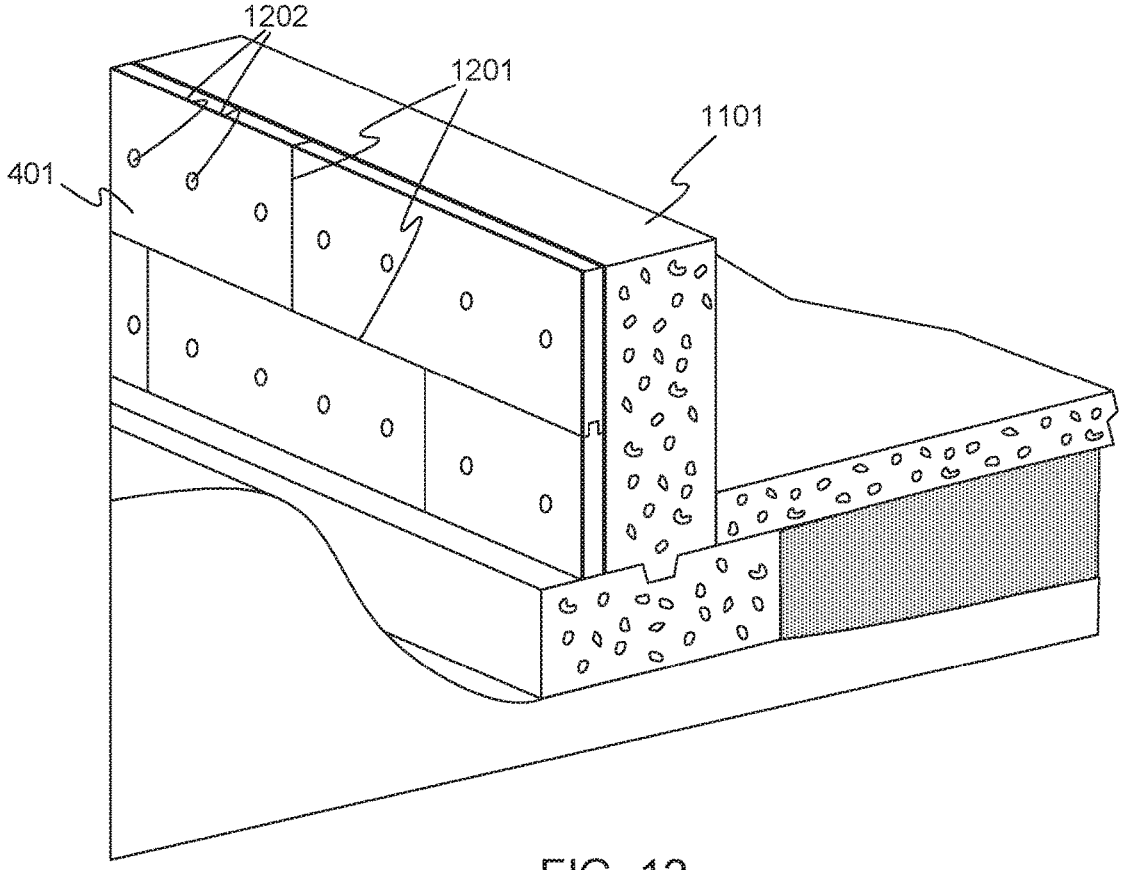
FIG. 12 shows the wall assembly of FIG. 11 in an oblique view, including a waterproofing layer.

FIG. 12 shows wall assembly 1101 in an oblique view. (Anchor bolts and the like have been omitted for clarity, but may be present.) Side 401 may include joints 1201 between the foam-containing boards that make up side 401, and may include partial-thickness openings 1202 where form ties 904 were broken off.

Figure 13:
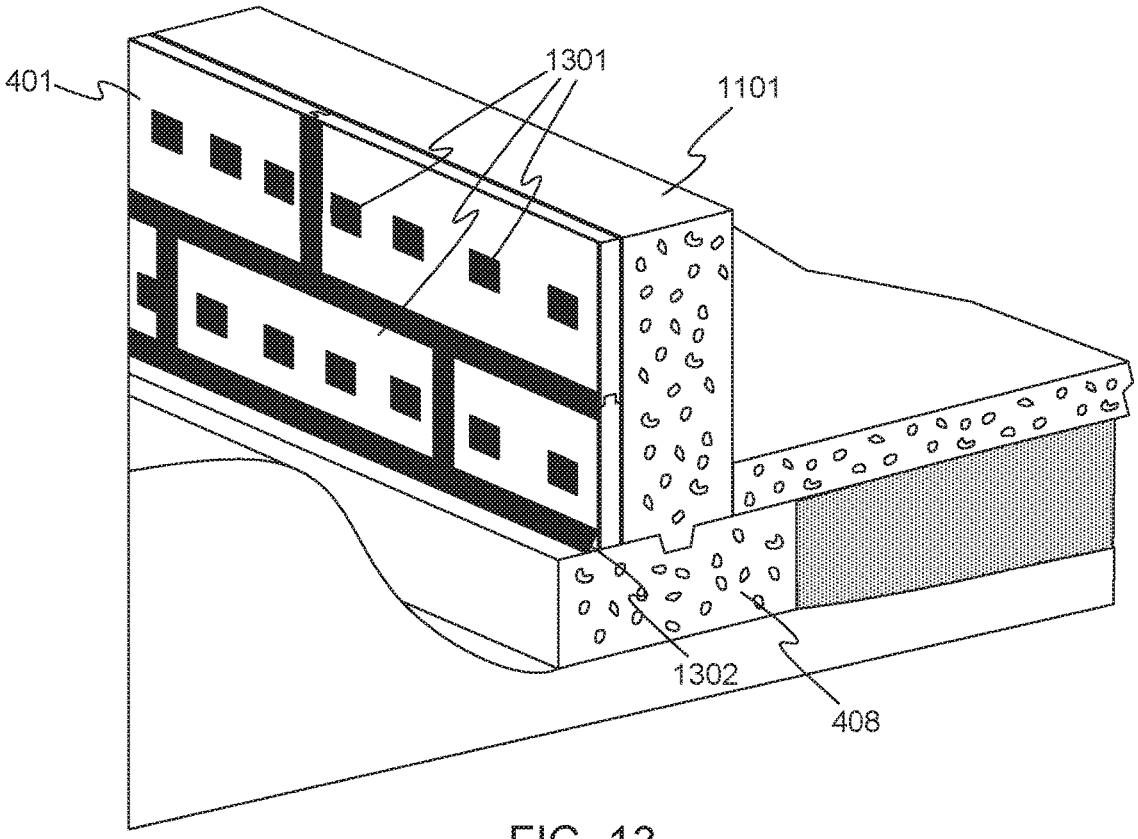
FIG. 13 illustrates the sealing of openings in the waterproofing layer of FIG. 12.

FIG. 13 shows the joints 1201 and openings 1202 covered with a sealant 1301, for example, ZIP System™ tape available from Huber Engineered Woods of Charlotte, N.C., USA, or another suitable kind of tape. The portion of the outer surface of side 401 that requires a secondary sealant may be exaggerated in FIG. 13. Typically, joints 1201 and openings 1202 are small in relation to the area of wall assembly 1101. A bead of caulk 1302 may also be applied to the joint between footer 408 and side 401. Caulk 1302 may be, for example, Tremco Dymonic® 100 sealant also available from Tremco Incorporated, or another suitable kind of caulk or sealant.

In other embodiments, joints 1201 and openings 1202 may be sealed using a sealant such as GoBoard® Sealant available from Johns Manville. A combination of a sealant and an adhesive tape may be used if desired.

Concrete wall assemblies made according to the above description may have one or more advantages over conventional concrete walls. For example, a polymer foam board may be made thicker, stronger, more flex resistant than plywood, so fewer braces may be required in the forms for the wall, reducing the labor required to make the wall. The boards also provide thermal insulation to the wall. For example, a two-inch thick Invinsa® panel may have an insulating value of about R 10, while a one-inch thick panel of GoBoard® may have an insulating value of about R 5.

Figure 14:
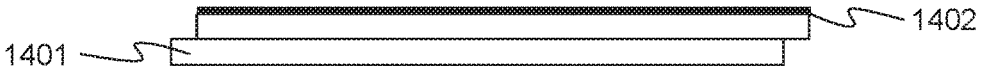
FIG. 14 shows an edge view of a board in accordance with other embodiments of the invention.
Figure 15:
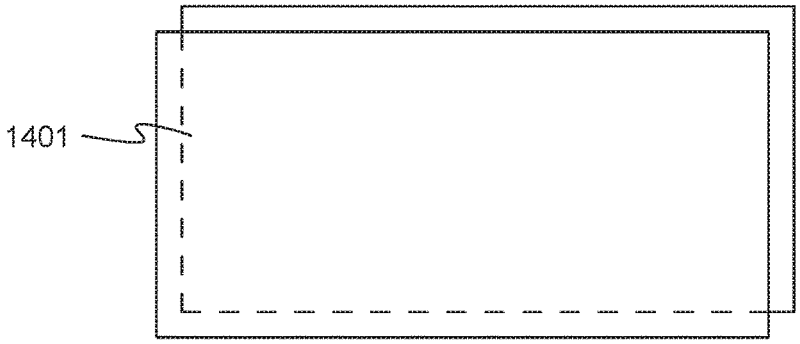
FIG. 15 shows a face view of the board of FIG. 14.
Figure 16:
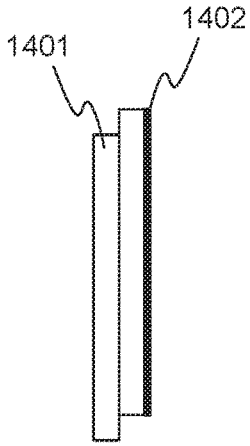
FIG. 16 shows an end view of the board of FIG. 14.

FIGS. 14-16 illustrate edge, face, and end views of a board 1401 in accordance with other embodiments of the invention. Board 1401 also includes a fibrous facer 1402 on one major surface. The perimeter edges of board 1401 are cut in a "shiplap" fashion on all four edges, so that the boards can engage with the shiplap cuts of vertically- and horizontally-adjacent boards. Other methods of creating overlap between adjacent boards may be used as well. The shiplap or other overlapping edges may be premolded channels or caps that are bonded onto the rectangular foam boards. These caps can be produced from foam such as high density polyisocyanurate or closed cell EPDM or extruded metal or extruded plastic. The caps can be pre-applied at the board factory or on the job site. Preferably, the caps are installed in a manner that maintains a water tight seal when the assembly is combined at the job site. In other embodiments, the edges of the boards may be beveled, may include curved mating surfaces, or may have other suitable shapes.

Figure 17:
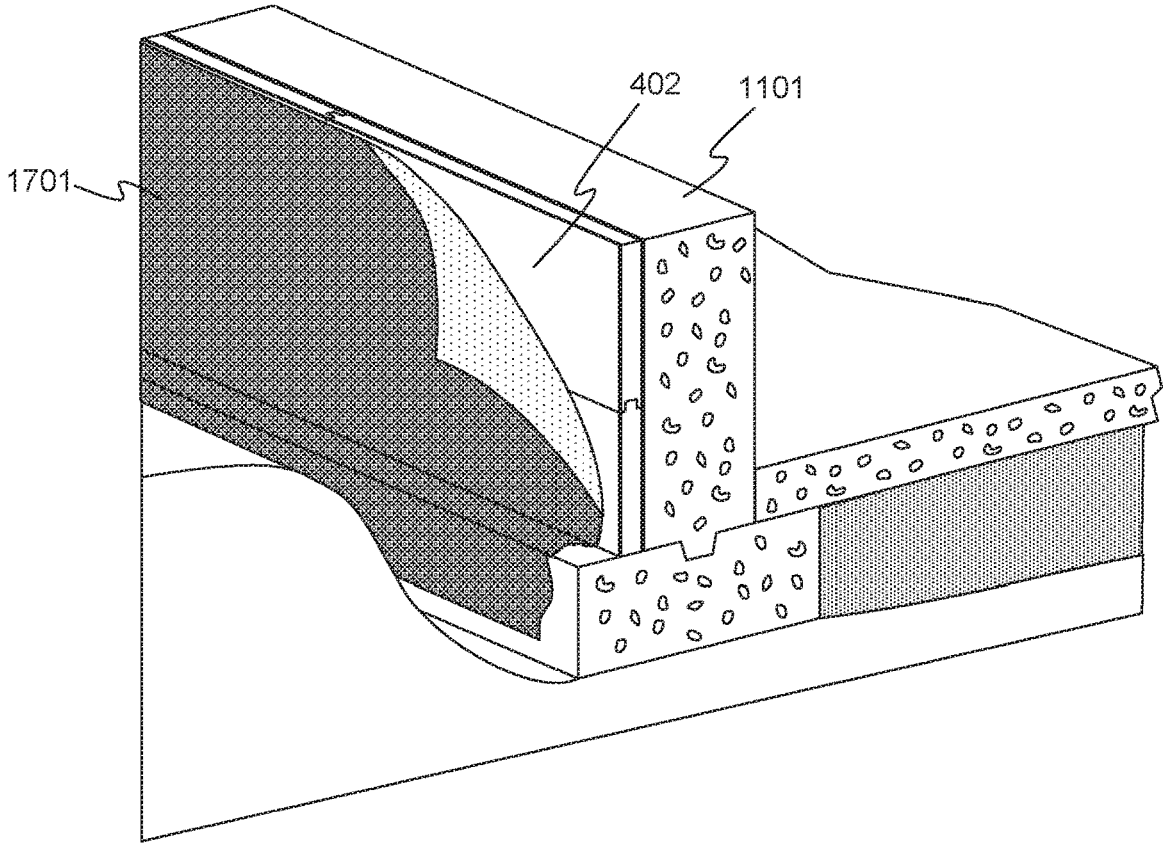
FIG. 17 illustrates the application of a waterproofing membrane to the wall assembly of FIG. 11, in accordance with embodiments of the invention.

In some embodiments, a waterproof layer may be applied to the outside surface of the boards, in place of or in addition to any tape or other sealant. For example, a roll- or spray-applied waterproofing layer may be applied if desired. In other embodiments, a membrane 1701 made of styrene butadiene styrene (SBS), thermoplastic polyolefin (TPO), ethylene propylene diene monomer (EPDM), or another suitable material, or a combination of materials, may be applied as shown in FIG. 17.

Figure 18:
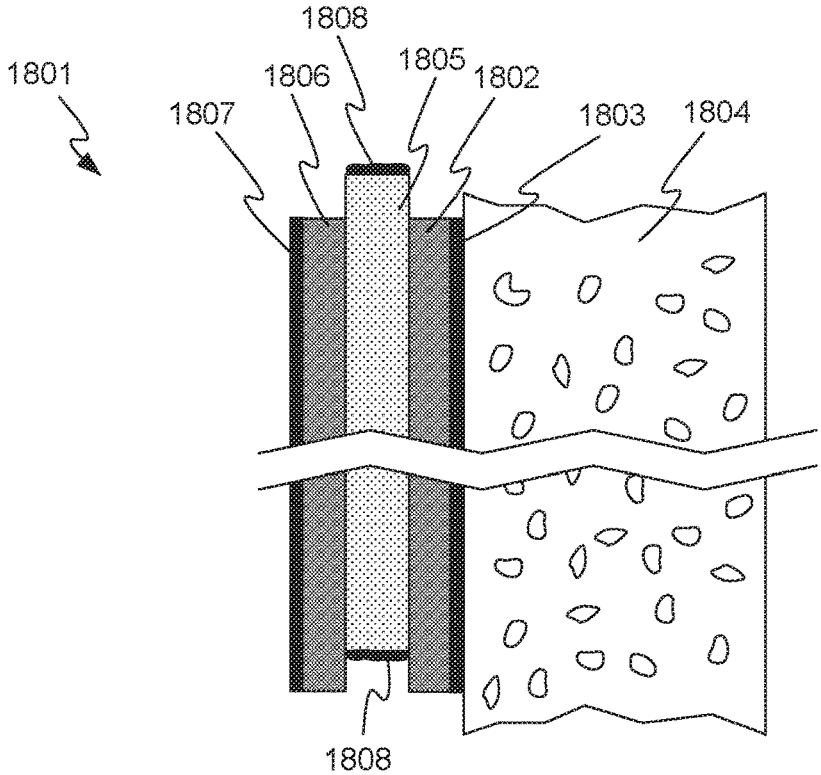
FIG. 18 illustrates an end view of a portion of a multi-layer board in accordance with other embodiments of the invention, as installed in a concrete wall assembly.

In some embodiments, boards used in embodiments of the invention may include multiple layers of foam or other materials. For example, FIG. 18 illustrates an end view of a portion of a multi-layer board 1801 in accordance with other embodiments of the invention, as installed in a concrete wall assembly.

Multi-layer board 1801 includes a first polymer foam layer 1802. First layer 1802 may be a rigid foam having a relatively high density, for example between 2.5 lb/ft$^3$ and 25 lb/ft$^3$. First layer 1802 may be of any suitable thickness, for example between about ¼ and 6 inches. The foam in first layer 1802 may be polyisocyanurate foam, polyurethane foam, or another kind of foam. In some embodiments, first layer 1802 may be an Invinsa® or GoBoard® board available from Johns Manville.

A fibrous facer 1803 is joined to first layer 1802 and faces concrete wall 1804. For example, facer 1803 may be a nonwoven facer comprising fiberglass or another fibrous material. Some of concrete 1804 is infused into facer 1803, facer 1803 having been present during pouring of concrete 1804.

Multi-layer board 1802 includes a second polymer foam layer 1805. Second layer 1805 may be an insulating foam such as a lower-density spray polyurethane foam, a pour-in-place foam, or a polyisocyanurate foam having a density between about 2.5 and 4 lb/ft$^3$. Second layer 1805 may be of any appropriate thickness, for example from ¼ to 6 inches, or another workable thickness.

Multi-layer board 1801 further includes a third polymer foam layer 1806. Third layer may be of similar thickness and density to first layer 1802. An outer layer 1807 may be provided, in the form of an additional facer, or in the form of an SBS, TPO, or EPDM membrane, a polyamide (nylon) film, or another kind of membrane. Outer layer 1807 may provide additional waterproofing, a more durable surface than the surface of the foam layers, a more visually appealing surface, or other advantages. For example, outer layer may be self-sealing when punctured. In other embodiments, tape or a sealant may be used on the exterior surface of board 1801, to seal any gaps between the membranes of adjacent boards.

Layers 1802, 1805, and 1806 may be created together in the manufacturing process of board 1801, such that board 1801 is a composite board having three layers and facer 1803. In other embodiments, one or more of the layers may be added to the board at the construction site. While three polymer foam layers are shown in FIG. 18, more or fewer layers may be used.

In some embodiments, a pre-applied sealant 1808 may be provided on board 1801. Pre-applied sealant 1808 may be, for example, a compressible foam material, a thixotropic liquid, paste, or gel, or another kind of sealant. When adjacent boards are assembled together, sealant 1808 contacts both adjacent panels to seal the passage between them.

While sealant 1808 is shown only on the top tongue and in the bottom groove of board 1801, sealant 1808 may also be placed on the ends of a panel. Similarly, a sealant such as sealant 1808 may be used in any of the embodiments described herein, including the single foam layer embodiments of FIGS. 4-17.

In some embodiments, layers 1802, 1805, and 1806 of board 1801 may be made of the same kind of foam, having the same density.

Figure 19:
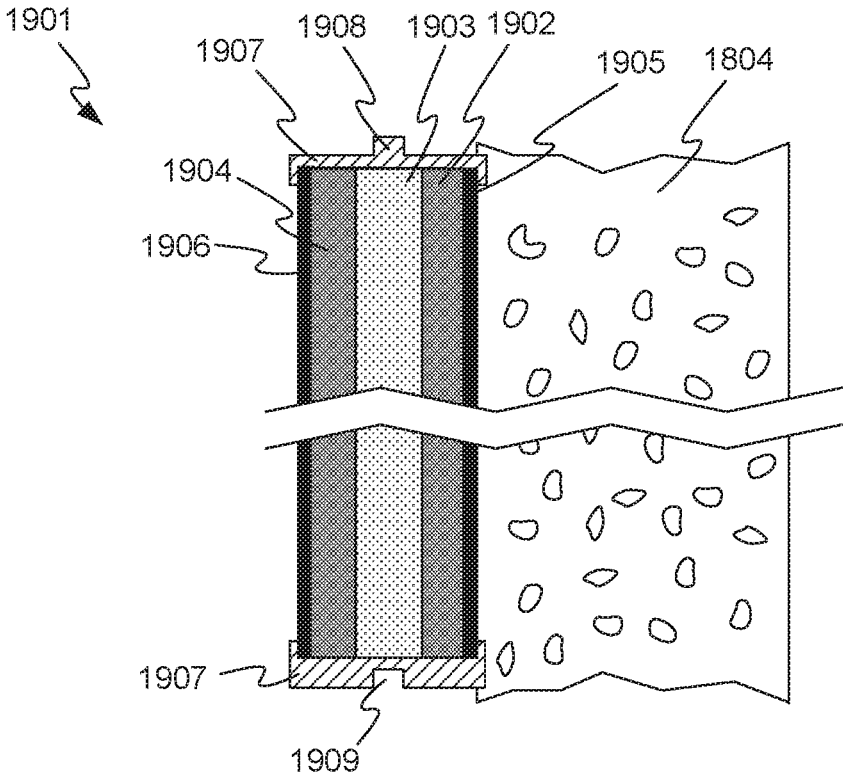
FIG. 19 illustrates a multi-layer board in accordance with other embodiments.

FIG. 19 illustrates a multi-layer board 1901 in accordance with other embodiments. Multi-layer board 1901 includes layers 1902, 1903, and 1904, similar to layers 1802, 1805, and 1806 described above. Board 1901 also includes a facer 1905, and may include an outer layer 1906, such as an additional facer or a waterproofing membrane similar to outer layer 1807 described above. Sealing material 1907 forms a tongue and groove arrangement with adjacent boards. For example, tongue 1908 may engage with a groove on an adjacent panel, similar to groove 1909. Sealing material 1907 may be provided as a cap on the edges of the boards, made of plastic material, foam, metal, or another suitable material. The caps may be factory installed or installed at the job site. Caps may be used to provide overlapping edges in other kinds of boards as well, for example the single-foam-layer boards described above.

Figure 20:
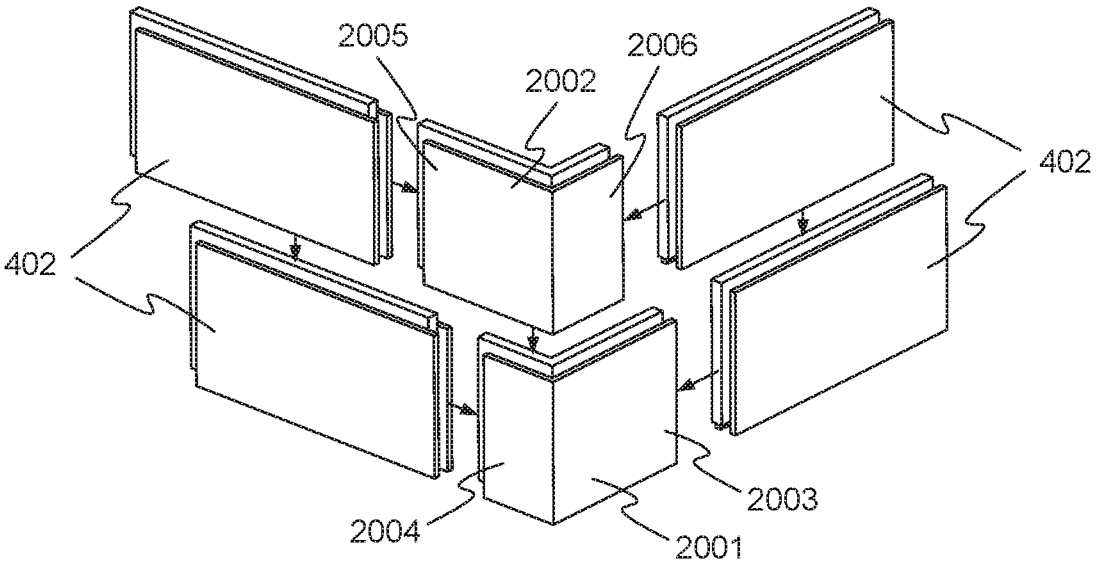
FIG. 20 illustrates the use of corner pieces for construction forms for corners in a foundation in accordance with embodiments of the invention.
Figure 21:
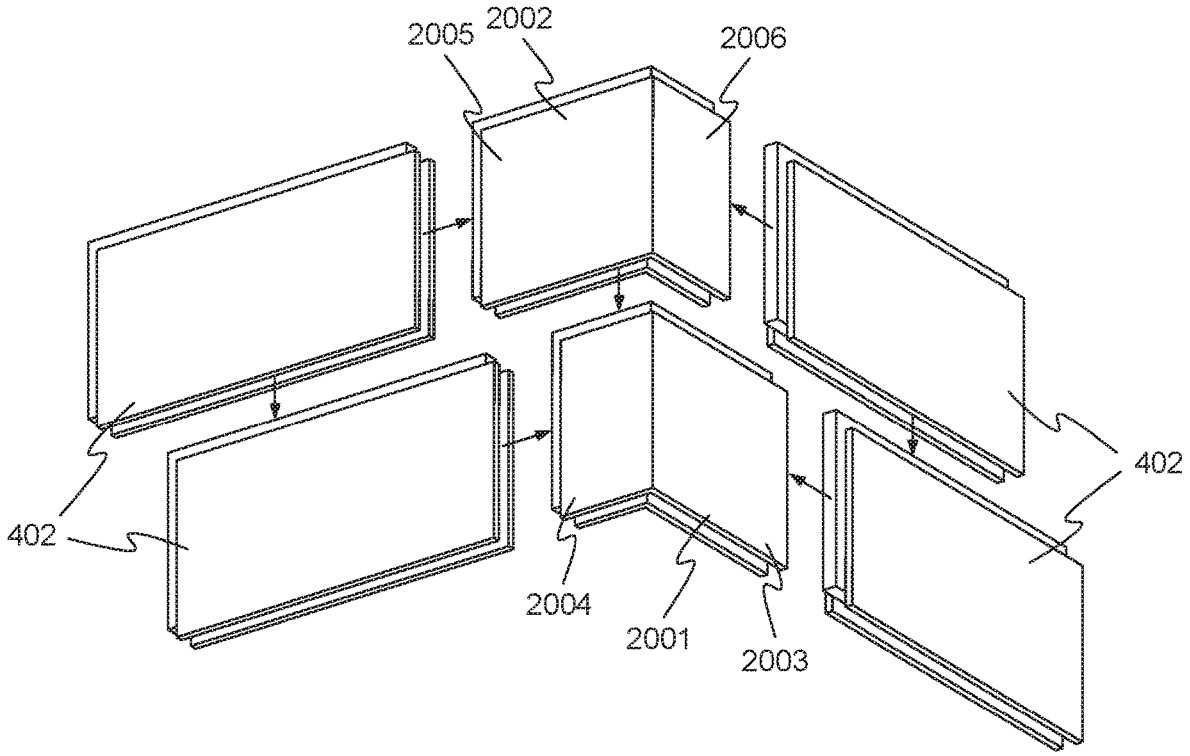
FIG. 21 illustrates the use of corner pieces as in FIG. 20, from a lower oblique view.

FIGS. 20 and 21 illustrate the use of corner pieces 2001 and 2002 for constructing forms for corners in a foundation in accordance with embodiments of the invention. Corner pieces 2001 and 2002 are shown as being compatible with and used with tongue-and-groove boards 402, but similar principles may be applied to corner pieces for use with other kinds of boards.

Corner pieces 2001 and 2002 are preferably made of the same kinds of materials as the boards they are used with, for example boards 402 as shown, although this is not a requirement. Each of corner pieces 2001 and 2002 has edges formed compatibly with edges of the flat boards, so that a board such as board 402 can be joined to each leg of each corner piece, creating overlaps for good sealing. In the example of FIG. 20, corner piece 2001 has one long leg 2003 and one short leg 2004. Corner piece 2002 also has a long leg 2005 and a short leg 2006, but long and short legs 2005 and 2006 are placed on opposite sides of corner piece 2002, as compared with long and short legs 2003 and 2004 of corner piece 2001. This allows stacking of corner pieces and staggering of the joints between adjacent boards 402.

While in the examples above, the boards are stacked with their long dimensions horizontal, this is not a requirement. The boards may be installed "on end" with their long dimensions vertical if desired. The vertical orientation may result in fewer joints between boards, depending on the height of the wall being constructed and the size of the boards being used.

Embodiments of the invention may provide one or more advantages as compared with prior art methods of waterproofing a concrete wall. For example, foam boards, membranes, and sealing materials as described are weather resistant, and are not harmed by being left exposed to the elements while other construction proceeds. Because the waterproofing layer is formed integrally with the concrete wall, there is no need to wait for the concrete to cure before waterproofing can be required. Similarly, these materials are not damaged by backfilling, and can remain in contact with backfill soil indefinitely. In addition, the waterproofing systems and methods may not require any volatile organic compounds (VOCs) as may be present in spray-applied waterproofing coatings, and no personal protective equipment may be needed during installation.

Having described several embodiments, it will be recognized by those of skill in the art that various modifications, alternative constructions, and equivalents may be used without departing from the spirit of the invention. Additionally, a number of well-known processes and elements have not been described in order to avoid unnecessarily obscuring the present invention. Accordingly, the above description should not be taken as limiting the scope of the invention.

Where a range of values is provided, it is understood that each intervening value, to the tenth of the unit of the lower limit unless the context clearly dictates otherwise, between the upper and lower limits of that range is also specifically disclosed. Each smaller range between any stated value or intervening value in a stated range and any other stated or intervening value in that stated range is encompassed. The upper and lower limits of these smaller ranges may independently be included or excluded in the range, and each range where either, neither or both limits are included in the smaller ranges is also encompassed within the invention, subject to any specifically excluded limit in the stated range. Where the stated range includes one or both of the limits, ranges excluding either or both of those included limits are also included.

As used herein and in the appended claims, the singular forms "a", "an", and "the" include plural referents unless the context clearly dictates otherwise. Thus, for example, reference to "a process" includes a plurality of such processes and reference to "the device" includes reference to one or more devices and equivalents thereof known to those skilled in the art, and so forth.

Also, the words "comprise," "comprising," "include," "including," and "includes" when used in this specification and in the following claims are intended to specify the presence of stated features, integers, components, or steps, but they do not preclude the presence or addition of one or more other features, integers, components, steps, acts, or groups.

What is claimed is:

1. A waterproofed concrete wall assembly, comprising:

a vertical wall of hardened concrete, the wall having a first side and a second side; and a plurality of boards, each of the plurality of boards comprising opposite first and second major surfaces and comprising perimeter edges between the major surfaces, and each of the plurality of boards comprising a polymer foam layer and a fibrous facer joined to the polymer foam layer;

wherein the first major surface of each of the plurality of boards is disposed in contact the first side of the vertical wall of hardened concrete;

and wherein at least some of the perimeter edges of the boards are shaped to overlap with shaped perimeter edges of one or more adjacent boards;

and wherein some of the concrete is infused into the fibrous facer, the fibrous facer having been present during pouring of the concrete.

2. The waterproofed concrete wall of assembly of claim 1, wherein at least some of the perimeter edges of the boards comprise caps shaped to provide the overlapping shapes.

3. The waterproofed concrete wall of assembly of claim 2, wherein the caps are made of metal, plastic, or polymer foam.

4. The waterproofed concrete wall of assembly of claim 1, wherein the polymer foam of the polymer foam layer is a polyisocyanurate foam.

5. The waterproofed concrete wall of assembly of claim 4, wherein the polyisocyanurate foam has a density between 2.5 $lb/ft^3$ and 25 $lb/ft^3$.

6. The waterproofed concrete wall of assembly of claim 4, wherein the polyisocyanurate foam has a density between 4 $lb/ft^3$ and 15 $lb/ft^3$.

7. The waterproofed concrete wall of assembly of claim 1, wherein the fibrous facer is a nonwoven facer comprising fiberglass.

8. The waterproofed concrete wall of assembly of claim 1, wherein the fibrous facer is a nonwoven spunbond facer comprising polyester or polypropylene.

9. The waterproofed concrete wall of assembly of claim 1, further comprising a sealant placed at the shaped perimeter edges of at least some adjacent boards.

10. The waterproofed concrete wall of assembly of claim 9, wherein the sealant is a compressible polymeric foam.

11. The waterproofed concrete wall of assembly of claim 9, wherein the sealant is a pre-applied adhesive.

12. The waterproofed concrete wall of assembly of claim 1, further comprising tape positioned to seal joints between adjacent boards on the second major surfaces of the adjacent boards.

13. The waterproofed concrete wall of assembly of claim 1, further comprising a waterproof layer in contact with the second major surfaces of the boards.

14. The waterproofed concrete wall of assembly of claim 13, wherein the waterproof layer is a membrane comprising one or more substances selected from the group of substances consisting of styrene butadiene styrene (SBS), thermoplastic polyolefin (TPO), ethylene propylene diene monomer (EPDM), and polyamide film (nylon).

15. The waterproofed concrete wall of assembly of claim 13, wherein the waterproof layer is a second facer joined to the polymer foam.

16. The waterproofed concrete wall of assembly of claim 1, wherein at least some of the boards comprise multiple layers of polymer foam of different densities.

* * * * *